US007290900B1

(12) United States Patent
Tsai

(10) Patent No.: US 7,290,900 B1
(45) Date of Patent: Nov. 6, 2007

(54) LIGHT-STRING ORNAMENTAL FRAME ASSEMBLY

(76) Inventor: George Tsai, 4th Fl., No. 403, Sec. 4, Jen-Ai Rd., Taipei (TW)

( * ) Notice: Subject to any disclaimer, the term of this patent is extended or adjusted under 35 U.S.C. 154(b) by 0 days.

(21) Appl. No.: 11/640,295

(22) Filed: Dec. 18, 2006

(51) Int. Cl.
*F21V 21/00* (2006.01)

(52) U.S. Cl. ..... 362/252; 362/249; 362/806

(58) Field of Classification Search ..... 362/123, 362/124, 249, 252, 358, 360, 367, 434, 806, 362/808; 428/13, 14, 19, 27
See application file for complete search history.

(56) References Cited

U.S. PATENT DOCUMENTS 1,134,834 A * 4/1915 Fisher, Sr. ..... 362/808
4,596,726 A * 6/1986 Wrzalinski ..... 428/27
5,379,202 A * 1/1995 Daun ..... 362/252
5,921,668 A * 7/1999 Bayer ..... 362/806
6,663,259 B2 * 12/2003 Westfall ..... 362/249
2003/0107886 A1 * 6/2003 Pan ..... 362/124

* cited by examiner

*Primary Examiner*—Y. My Quach-Lee
(74) *Attorney, Agent, or Firm*—Birch, Stewart, Kolasch & Birch, LLP

(57) ABSTRACT

The light-string ornamental frame assembly has at least one frame, multiple slices, multiple strips, a string of light having multiple bulbs. The slices are bound on the frame with the multiple strips. The string of light is wound on the frame. When the string of light emits light, the light will be refracted by the slices to provide 3-D visual effect.

14 Claims, 8 Drawing Sheets

LIGHT-STRING ORNAMENTAL FRAME ASSEMBLY

BACKGROUND OF THE INVENTION

1. Field of Invention

The present invention relates to a light-string ornamental frame assembly, and more particularly to a light-string ornament having a hollow frame wound a string of light to provide the 3D visual effect.

2. Description of the Related Art

People are fond of using ornaments to enhance the ambiance of festivals or holidays, but ornaments are not conspicuous enough to attract people easily. So people usually mount strings of light on ornaments to make them illuminate. Light-string ornaments are normally placed at entrances to houses, restaurants and exhibitions to decorate the environment.

A conventional light-string ornament in accordance with the prior art comprises a body, and a string of light. The string of light can be mounted on the body to make the ornament illuminate. The ornament can be any shape like a Christmas tree, snowman or the like. Because the body is too heavy to be moved, people produce hollow ornamental frame and shape it as a Christmas tree, snowman or the like, and then wind the string of light on the ornamental frames. These ornamental frames are easy to be moved. However, the conventional light-string ornamental frame assembly is lack of 3D visual effect.

To overcome the shortcomings, the present invention provides a light-string ornament frame to mitigate or obviate the aforementioned.

SUMMARY OF THE INVENTION

The primary objective of the present invention is to provide a light-string ornamental frame assembly full of 3-D visual effect. The light-string ornamental frame assembly has at least one hollow frame, multiple slices, multiple strips, a string of light having multiple bulbs. The slices are bound on the frame with the multiple strips. The string of light is wound on the frame. When the string of light is lighted, the light will be refracted by the slices to provide the 3-D visual effect.

Other objectives, advantages and novel features of the invention will become more apparent from the following detailed description when taken in conjunction with the accompanying drawings.

DETAILED DESCRIPTION OF THE INVENTION

Figure 1:
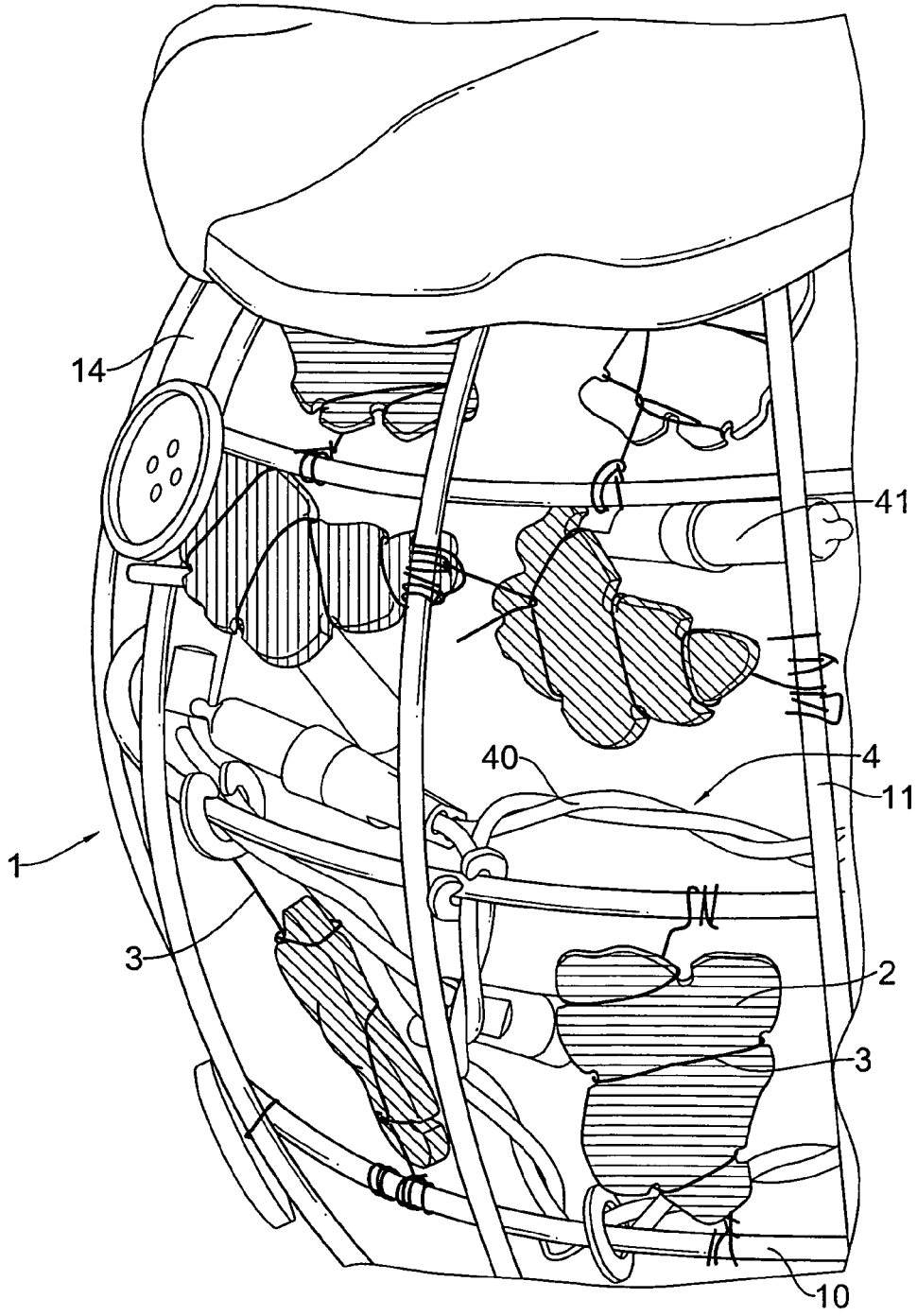
FIG. 1 is a partially perspective view of a light-string ornamental frame assembly in accordance with the present invention with multiple strips wound around slices.
Figure 2:
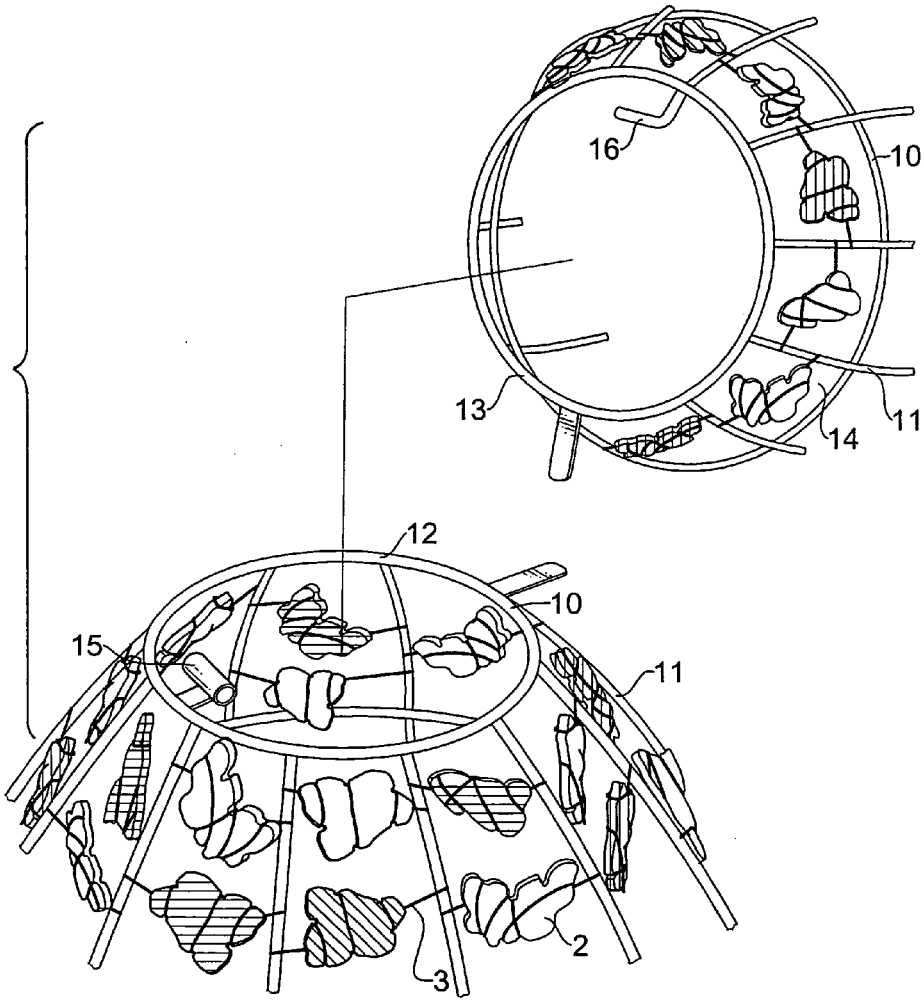
FIG. 2 is a partially exploded perspective view of the connector of the light-string ornamental frame assembly in accordance with the present invention.
Figure 4:
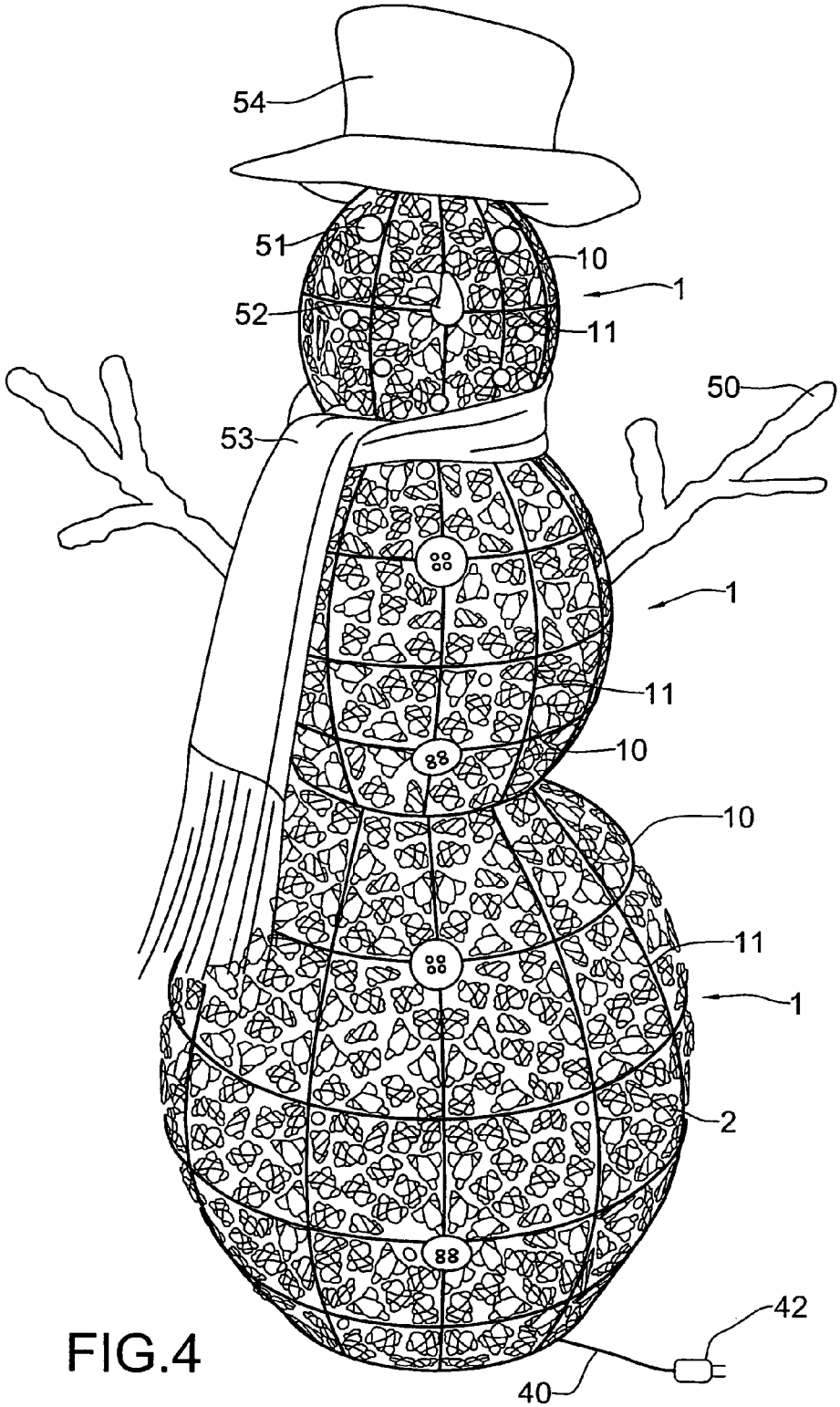
FIG. 4 is a front view of a first configuration of the light-string ornamental frame assembly in accordance with the present invention.
Figure 5:
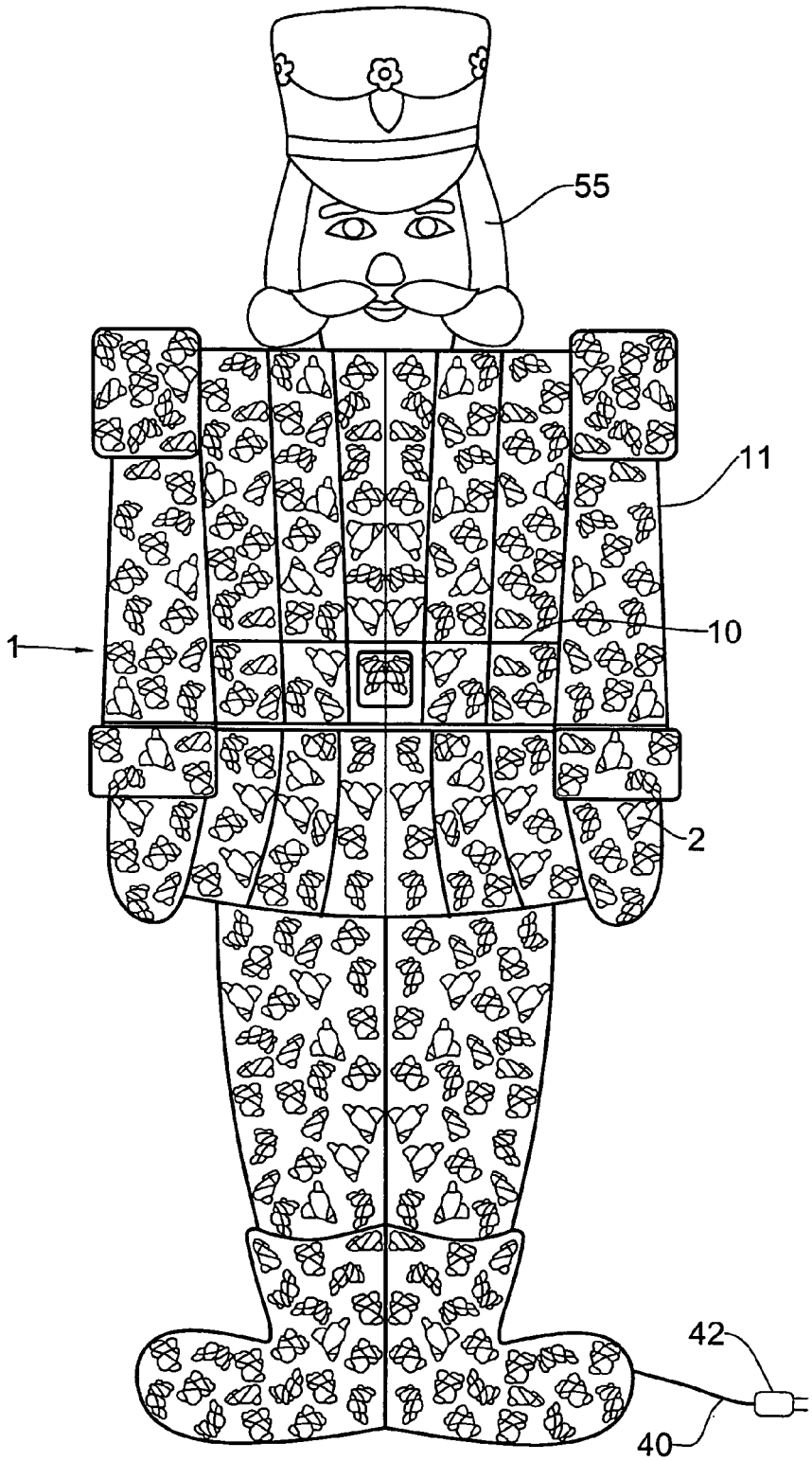
FIG. 5 is a front view of a second configuration of the light-string ornamental frame assembly in accordance with the present invention.
Figure 6:
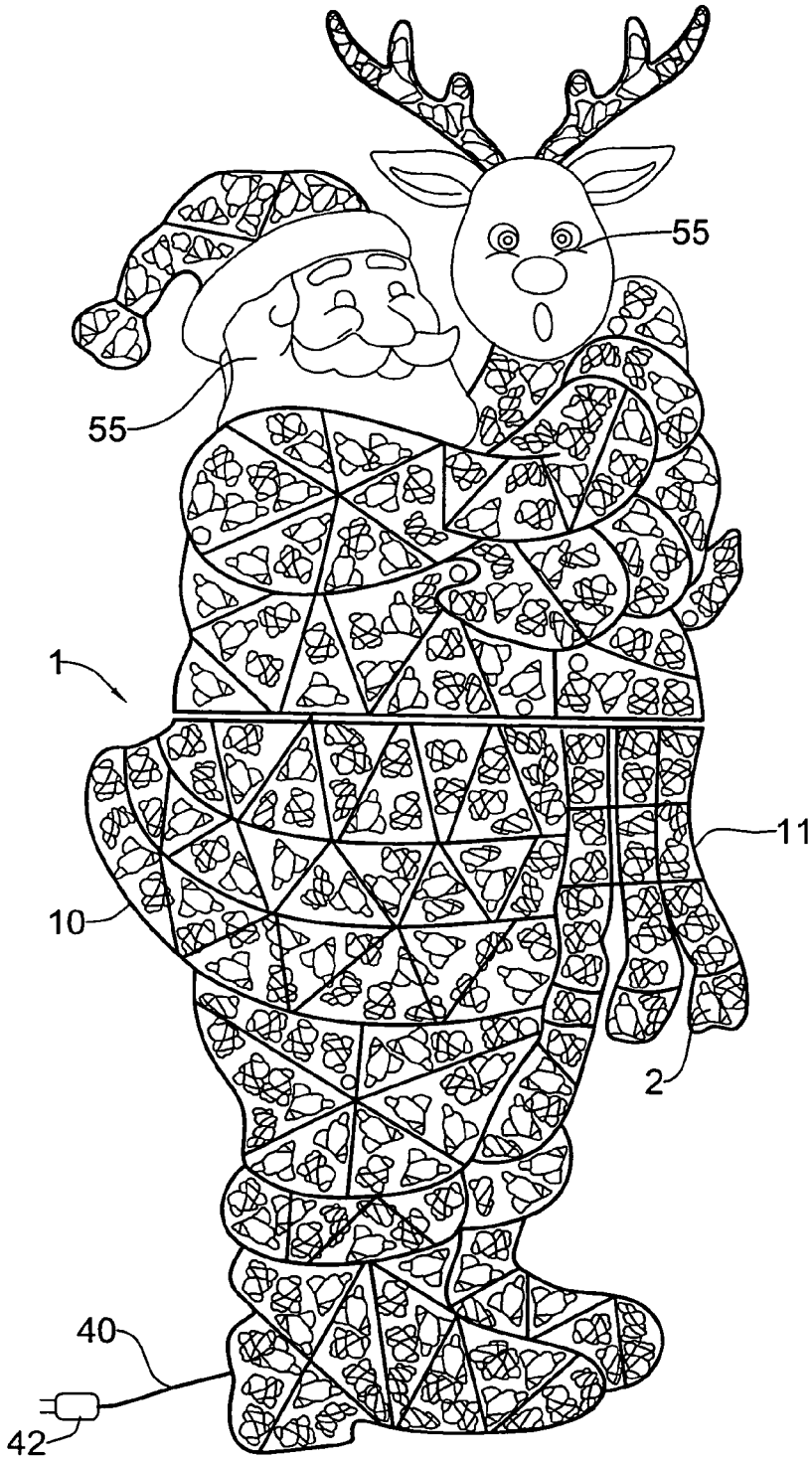
FIG. 6 is a front view of a third configuration of the light-string ornamental frame assembly in accordance with the present invention.
Figure 7:
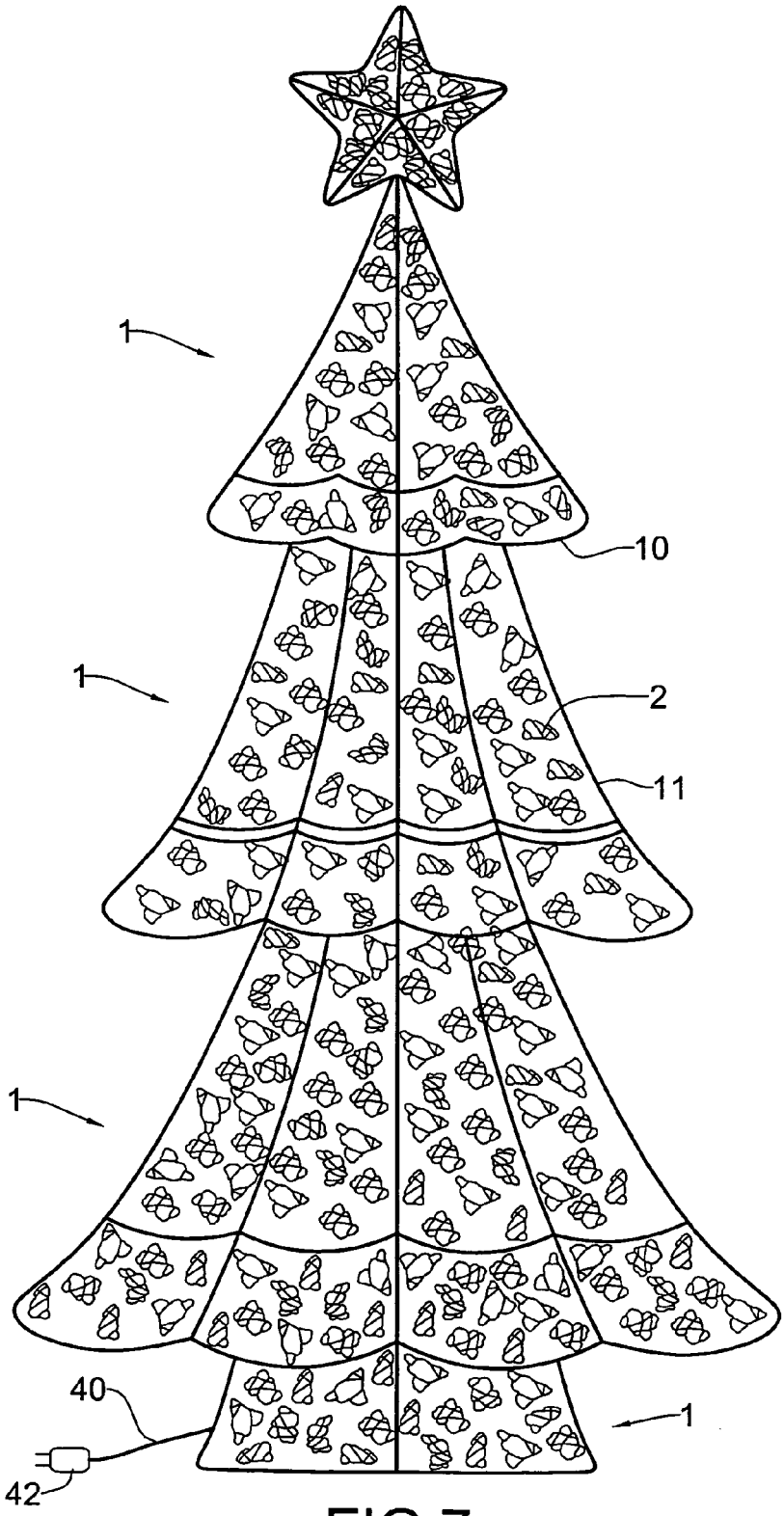
FIG. 7 is a front view of a fourth configuration of the light-string ornamental frame assembly in accordance with the present invention.
Figure 8:
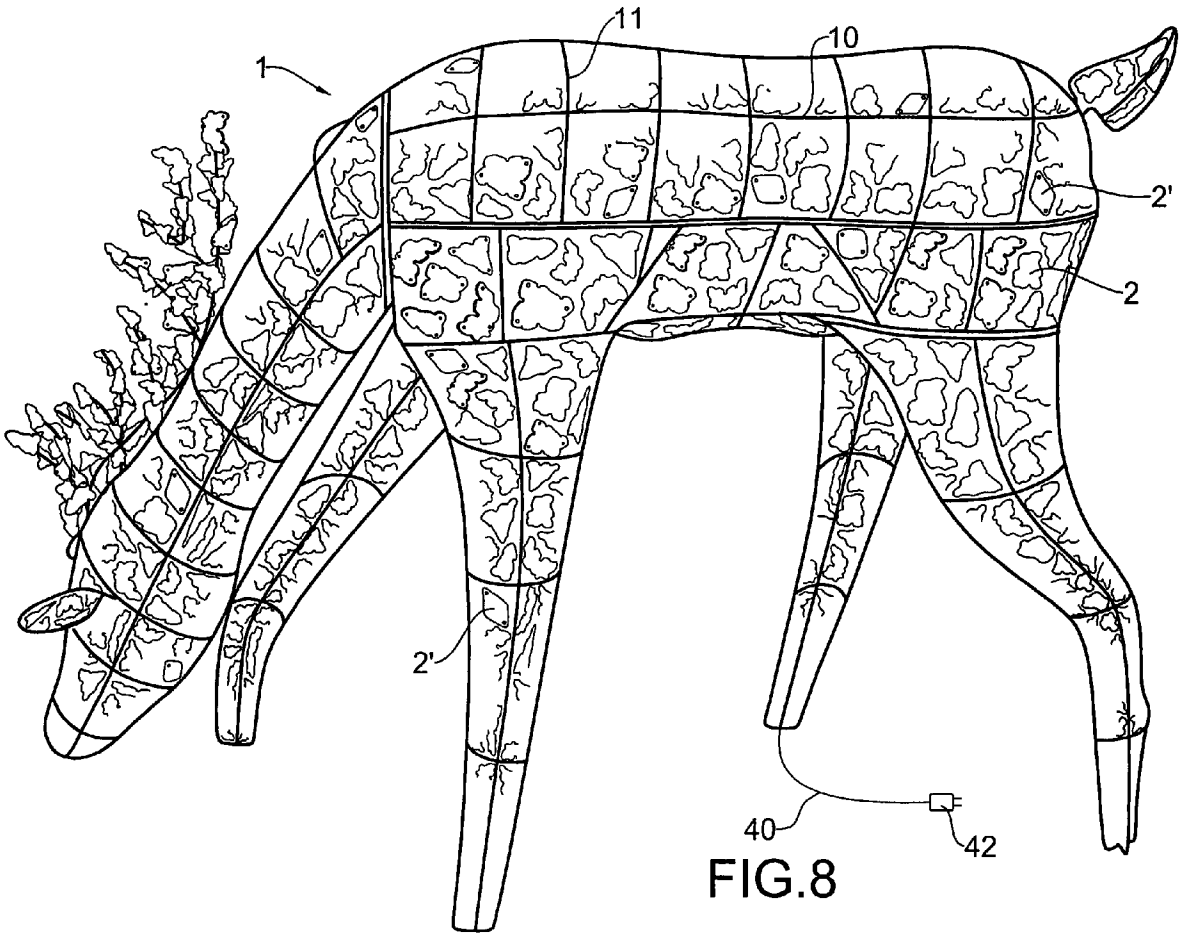
FIG. 8 is a side view of a fifth configuration of the light-string ornamental frame assembly in accordance with the present invention.

With reference to FIGS. 1, 2 and 4, a light-string ornamental frame assembly in accordance with the present invention has at least one frame (1), at least one frame connector, multiple slices (2), multiple strips (3), a string of light (4), and accessories.

With further reference to FIGS. 5 to 8, the at least one frame (1) may be any shapes and may stack on each other to form a configuration of a snowman, a soldier, Santa Claus, Christmas tree, deer or the like to make the light-string ornamental frame assembly more lively. Each frame (1) has a top edge (12) and a bottom edge (13), multiple warps (10), multiple woofs (11) and multiple intervals (14).

The intervals (14) are formed by the warps (10) intersecting the woofs (11).

Each of the at least one frame connector is mounted between a pair of adjacent frames when the light-string ornamental frame assembly has more than two frames and has a lower connector (15) and an upper connector (16). The lower connector (15) is at the top edge of one of the pair of the adjacent frames (1). The upper connector (16) at the bottom edge of the other one of the pair of the adjacent frames (1) and the lower connector (15) can connect with the upper connector (16) to combine more than two frames (1). The lower connector (15) may be a tube and may be a bolt, protrusion or the like. The upper connector (16) may be a bolt, protrusion or the like and may be a tube.

Figure 3:
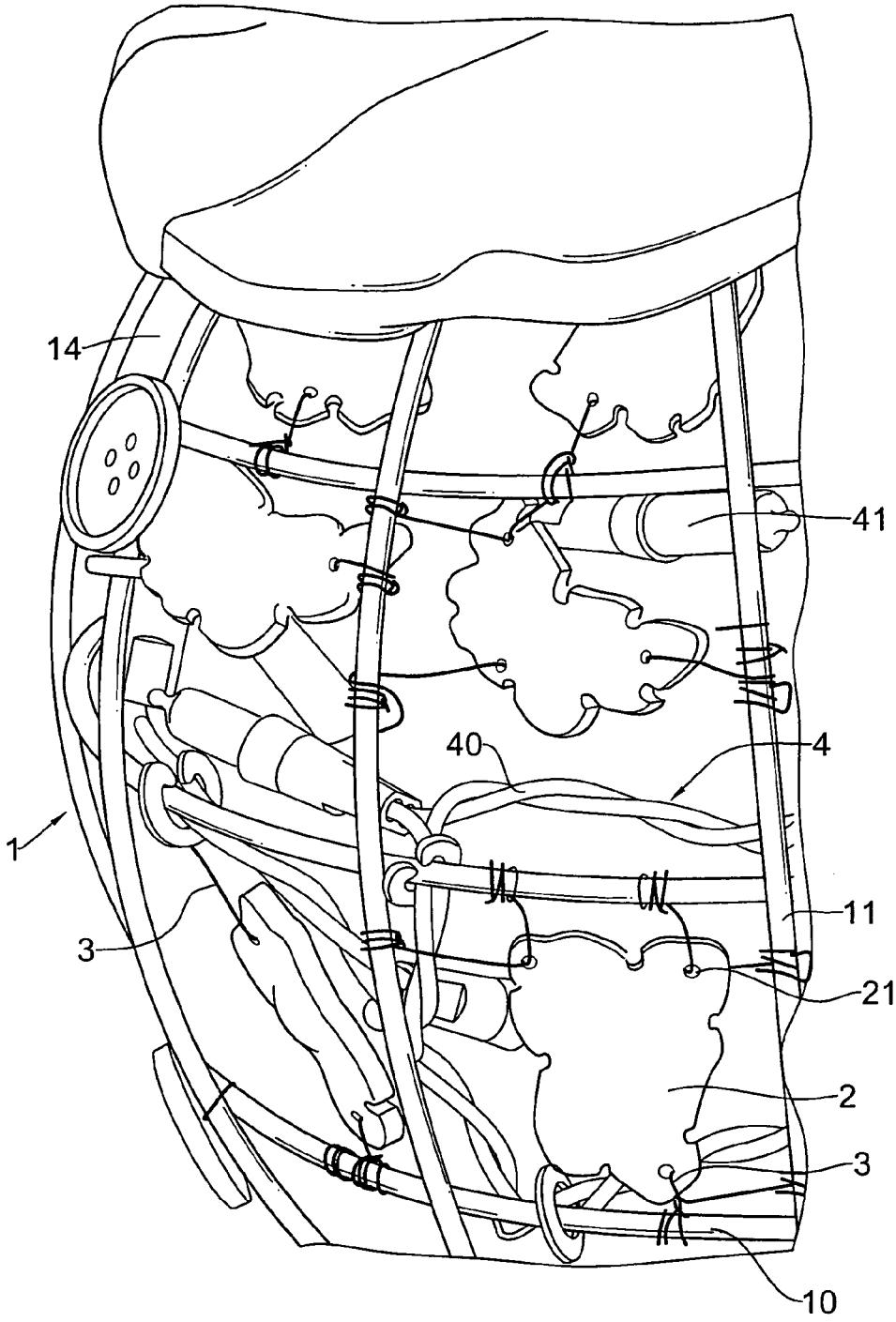
FIG. 3 is a partially perspective view of a light-string ornamental frame assembly in accordance with the present invention, which has multiple strips extend through multiple through holes of slices.

With further reference to FIG. 3, the multiple slices (2) may have relieves. Each of the slices (2) is mounted in one of the intervals (14) and may have multiple through holes (21). The slices (2) may be previous to light such as translucent or transparent and may be made of polyvinyl chloride (PVC) or other materials to reflect light as a mirror. Part of slices (2) mounted in the intervals (14) can be PVC slices (2') and part of slices (2) can be previous to light to create various visual effects. The slices (2) may be dye to different colors to provide the light-string ornamental frame assembly colorful.

The multiple strips (3) comprises a middle part and two ends. The middle part may be wound around one of the slices (2) or may extend through the through holes (21) in the corresponding slice (2). The two ends are bound on the wraps (10) and the woofs (11) to fix the corresponding slice (2) on the frame (1).

The string of light (4) is wound on the warps (10) and woofs (11) and has multiple bulbs (41), a plug (42), and electric wires (40). The bulbs (41) are mounted behind, beside or in front of the multiple slices (2). The electric wires (40) connects the bulbs (41) and the plug (42) together. When the electricity pass through the plug (42) and the electric wires (40) to illuminate the bulbs (41). The light, emitted from the bulbs (41), will be refracted by the multiple slices (2) to provide the 3D visual effect.

The accessories may be sticks (50), eyes (51), noses (52), scarves (53), hats (54) and artificial head (55) on the frame (1) to make light-string ornamental frame assembly more interesting.

Even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A light-string ornamental frame assembly comprising:
at least one frame, each one having
a top edge;
a bottom edge;
multiple warps;
multiple woofs intersecting the warps to form intersections; and
multiple intervals formed by intersections of the warps and the woofs;
multiple slices mounted in the intervals;
multiple strips connected to the slices and the at least one frame to fix the slices on the at least one frame, and each of the strips having
a middle part winding around one of the slices; and
two ends respectively binding on the two of the woofs and warps;
a string of light wound on the at least one frame and having
electric wires wound the string of light on the frame;
multiple light bulbs connecting with the electric wires; and
a plug connecting with the electric wires to allow electricity to pass through the plug and the electric wires into the light bulbs to make the bulbs illuminate.

2. The light-string ornamental frame assembly as claimed in claim 1, wherein
the light string ornamental frame assembly comprises more than two frames and further has
at least one frame connector, and each one of the at least one frame mounted between a pair of adjacent frames and having
a lower connector at the top edge of one of the pair of the adjacent frames; and
an upper connector at the bottom edge of the other one of the pair of the adjacent frames and connected with the lower connector to combine the frames.

3. The light-string ornamental frame assembly as claimed in claim 2, wherein the upper connector of each one of the at least one frame connector is a protrusion.

4. The light-string ornamental frame assembly as claimed in claim 3 further has accessories.

5. The light-string ornamental frame assembly as claimed in claim 2 further has accessories.

6. The light-string ornamental frame assembly as claimed in claim 1 further has accessories.

7. The light-string ornamental frame assembly as claimed in claim 1, wherein the multiple slices have different colors.

8. A light-string ornamental frame assembly comprising:
at least one frame, each one having
a top edge;
a bottom edge;
multiple warps;
multiple woofs intersecting the warps to form intersections; and
multiple intervals formed by intersections of the warps and the woofs;
multiple slices mounted in the intervals and each of the slices having multiple through holes;
multiple strips connected to the slices and the at least one frame to fix the slices on the at least one frame, and each of the strips having
a middle part extending through the through holes in one of the slices; and
two ends binding respectively on two of the multiple woofs and multiple warps;
a string of light wound on the at least one frame and having electric wires wound the string of light on the frame;
electric wires wound the string of light on the frame;
multiple light bulbs connecting with the electric wires; and
a plug connecting with the electric wires to allow electricity to pass through the plug and the electric wires into the light bulbs to make the bulbs illuminate.

9. The light-string ornamental frame assembly as claimed in claim 8, wherein
the light string ornamental frame assembly comprises more than two frames and further has
at least one frame connector, and each one of the at least one frame mounted between a pair of adjacent frames and having
a lower connector at the top edge of one of the pair of the adjacent frames; and
an upper connector at the bottom edge of the other one of the pair of the adjacent frames and connected with the lower connector to combine the frames.

10. The light-string ornamental frame assembly as claimed in claim 9, wherein the upper connector of each one of the at least one frame connector is a protrusion.

11. The light-string ornamental frame assembly as claimed in claim 10 further has accessories.

12. The light-string ornamental frame assembly as claimed in claim 9 further has accessories.

13. The light-string ornamental frame assembly as claimed in claim 8 further has accessories.

14. The light-string ornamental frame assembly as claimed in claim 8, wherein the multiple slices have different colors.

* * * * *